US011815057B2

(12) United States Patent
Goto et al.

(10) Patent No.: US 11,815,057 B2
(45) Date of Patent: Nov. 14, 2023

(54) FUEL INJECTOR AND INTERNAL COMBUSTION ENGINE INCLUDING FUEL INJECTOR

(71) Applicants: Bosch Corporation, Tokyo (JP); Robert Bosch GmbH, Stuttgart (DE)

(72) Inventors: Yuichiro Goto, Kanagawa (JP); Jing Yang, Kanagawa (JP); Vinzenz Neubert, Schwieberdingen (DE)

(73) Assignees: Bosch Corporation, Tokyo (JP); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/763,697

(22) PCT Filed: Aug. 6, 2020

(86) PCT No.: PCT/JP2020/030280
§ 371 (c)(1),
(2) Date: Mar. 25, 2022

(87) PCT Pub. No.: WO2021/059773
PCT Pub. Date: Apr. 1, 2021

(65) Prior Publication Data

US 2022/0341382 A1 Oct. 27, 2022

(30) Foreign Application Priority Data

Sep. 25, 2019 (JP) ..... 2019-174626

(51) Int. Cl.
*F02M 61/18* (2006.01)
*F02M 61/14* (2006.01)

(52) U.S. Cl.
CPC ..... *F02M 61/1806* (2013.01); *F02M 61/14* (2013.01)

(58) Field of Classification Search
CPC ..... F02M 61/1806; F02M 61/1813; F02M 61/1846; F02M 61/14; F02M 61/1833;
(Continued)

(56) References Cited

U.S. PATENT DOCUMENTS 1,494,020 A * 5/1924 Riehm ..... F02M 43/04 239/549
5,540,200 A * 7/1996 Naitoh ..... F02M 61/1826 123/585

(Continued)

FOREIGN PATENT DOCUMENTS

JP 2006348841 A * 12/2006
JP 2006348841 A 12/2006

(Continued)

OTHER PUBLICATIONS

Translation of International Search Report for Application No. PCT/JP2020/030280 dated Oct. 20, 2020 (5 pages).

*Primary Examiner* — Sizo B Vilakazi
*Assistant Examiner* — Brian R Kirby
(74) *Attorney, Agent, or Firm* — Michael Best & Friedrich LLP

(57) ABSTRACT

The present invention provides a fuel injector capable of suppressing separation of a fuel flow in an injection port during fuel injection. A fuel injector (30) includes plural injection ports (31*a* to 31*f*), each of which injects the fuel into an internal combustion engine (10). The plural injection ports (31*a* to 31*f*) are provided in plural on a first circle with a first radius (R1) and on a second circle with a larger second radius (R2) than the first radius (R1), and includes: a first injection port (31*a*), a center of an opening of which is provided on the first circle; and a second injection port (31*c*), a center of an opening of which is provided on the second circle on an opposite side of a tangent of the first circle, which passes the center of the opening of the first injection port, from a center axis (CF1) of the fuel injector (30). When seen in a cross section on the shortest line connecting the (Continued)

center of the first injection port (31*a*) and the center of the second injection port (31*c*), a first angle (θ1) defined by a center axis (CF2) of the first injection port (31*a*) and the center axis (CF1) of the fuel injector (30) is larger than a second angle (θ2) defined by a center axis (CF3) of the second injection port (31*c*) and the center axis (CF1) of the fuel injector (30).

10 Claims, 4 Drawing Sheets

(58) Field of Classification Search
CPC .... F02M 61/18; F02M 61/1826; F02M 61/10; F02B 23/0669; F02B 23/104
See application file for complete search history.

(56) References Cited

U.S. PATENT DOCUMENTS 6,070,812 A * 6/2000 Tani ..... F02M 69/042 239/585.4
7,059,547 B2 * 6/2006 Kobayashi ..... F02M 61/1853 239/557
7,100,848 B2 * 9/2006 Kobayashi ..... F02M 51/0678 239/585.4
7,216,624 B2 * 5/2007 Mizobuchi ..... F02M 61/184 123/305
7,237,527 B2 * 7/2007 Pontoppidan ..... F02M 61/1826 123/298
7,669,789 B2 * 3/2010 Hung ..... F02M 61/1853 239/596
10,995,655 B2 * 5/2021 Lizuka ..... F02B 23/0669
2001/0017325 A1 * 8/2001 Harata ..... F02M 51/0678 239/596
2002/0000483 A1 * 1/2002 Shoji ..... F02B 23/0696 239/533.2
2002/0185104 A1 * 12/2002 Arndt ..... F02B 23/104 123/305
2003/0234006 A1 * 12/2003 Saito ..... F02M 61/1853 239/533.2
2004/0011326 A1 * 1/2004 Yamashita ..... F02B 17/005 123/305
2009/0025680 A1 * 1/2009 Kihara ..... F02M 61/1813 123/299
2009/0065609 A1 * 3/2009 Suzuki ..... F02M 61/1853 239/265.27
2014/0252137 A1 * 9/2014 Oomura ..... F02M 61/1806 239/558

FOREIGN PATENT DOCUMENTS

JP 2007231852 A * 9/2007
JP 2007231852 A 9/2007
JP 2014001660 A 1/2014
JP 2017172492 A 9/2017

* cited by examiner

[FIG. 1]
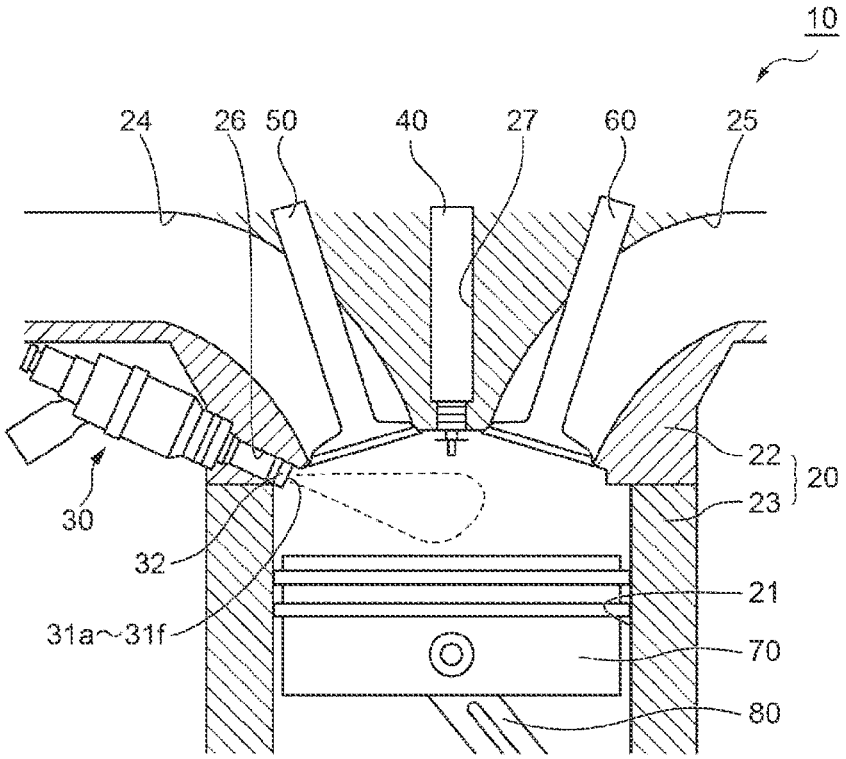

[FIG. 2]
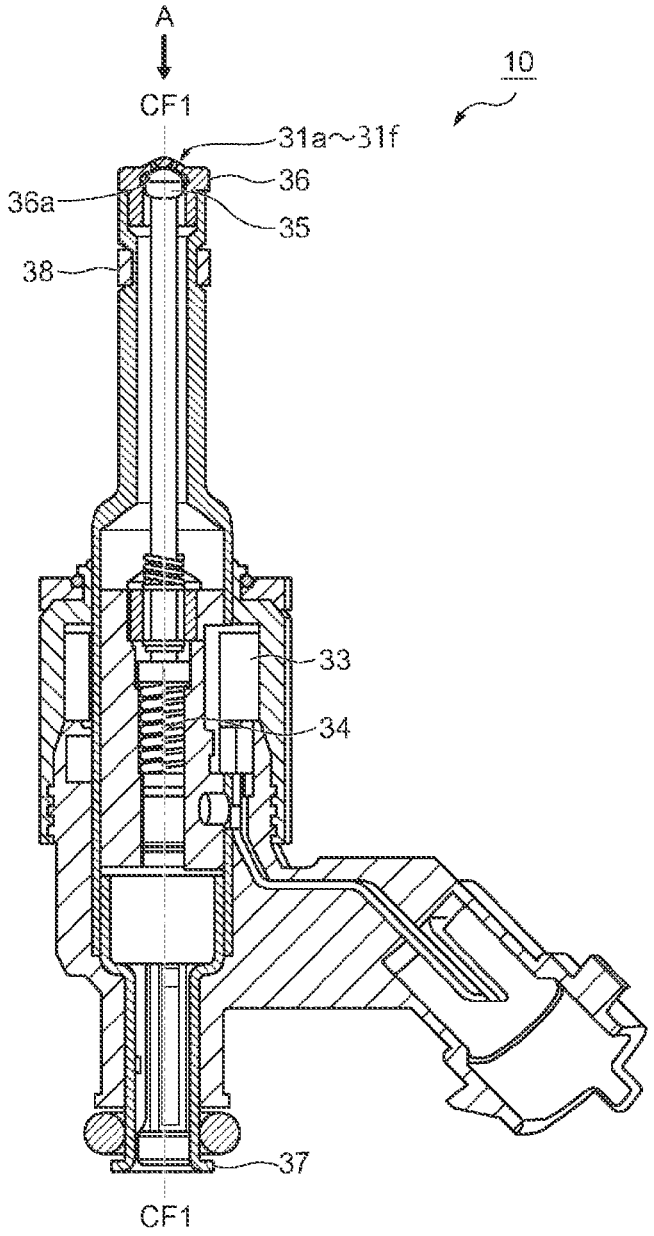

[FIG. 3]
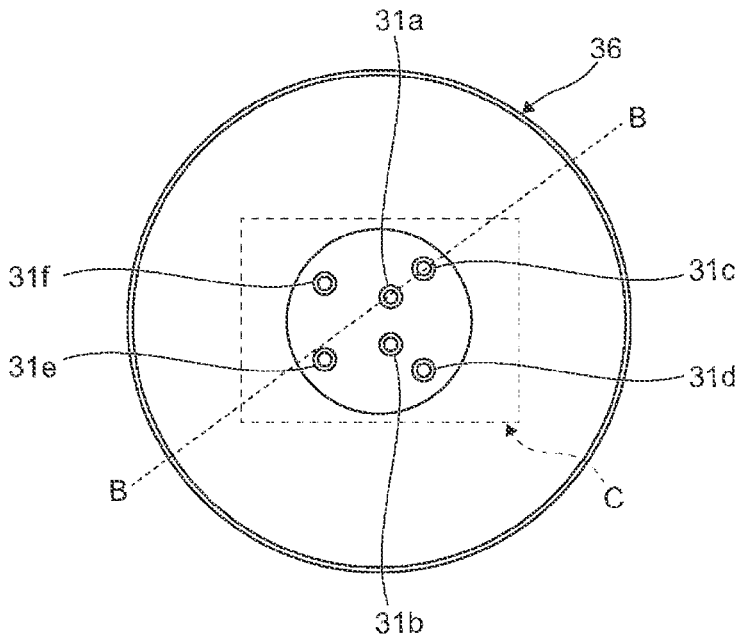
[FIG. 4]
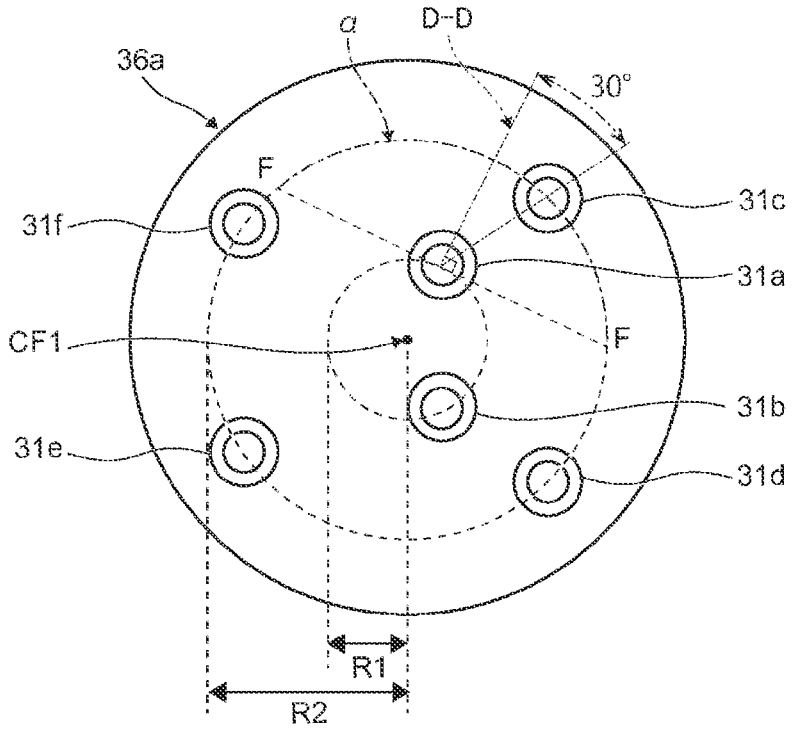

[FIG. 5]
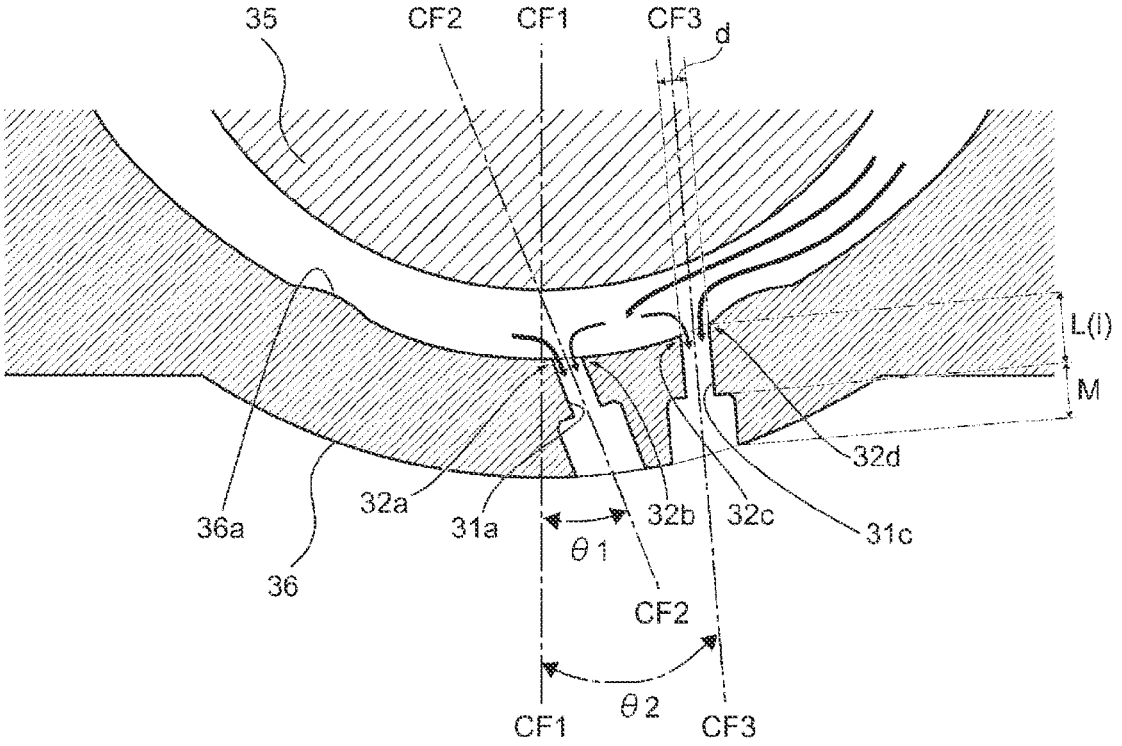

FUEL INJECTOR AND INTERNAL COMBUSTION ENGINE INCLUDING FUEL INJECTOR

BACKGROUND OF THE INVENTION

The present invention relates to a fuel injector that injects fuel into an internal combustion engine and to an internal combustion engine including the fuel injector.

As a conventional fuel injector, a fuel injector is configured to be provided with plural injection ports for injecting fuel in a tip portion of the fuel injector, to shut off injection of the fuel from the injection ports into a combustion chamber of the internal combustion engine when a valve body and a valve seat surface provided on the inside of the fuel injector abut each other, and to inject the fuel from the injection ports into the combustion chamber when the valve body and the valve seat surface separate from each other (for example, see JP-A-2014-1660).

SUMMARY OF THE INVENTION

In the fuel injectors disclosed in JP-A-2014-1660 and the like, a fuel flow is separated from a side surface (an inner wall surface) of the injection port at the time when the fuel is injected from the injection port. Consequently, some of the fuel injected from the injection port possibly spatters around the injection port, produces droplets, and adheres to an outer circumferential wall surface at a tip of the fuel injector. When the fuel produces the droplets and adheres to the tip of the fuel injector, incomplete combustion occurs, which is a cause of generation of unburned particle matters.

The present invention has been made with the above-described problem as the background and therefore has a purpose of providing a fuel injector capable of reducing separation of a fuel flow in an injection port during fuel injection.

A fuel injector according to the present invention is a fuel injector (30) that injects fuel into an internal combustion engine (10) from plural injection ports (31*a* to 31*f*). In the fuel injector (30), it is configured that the plural injection ports (31*a* to 31*f*) are provided in plural on a first circle with a first radius (R1) and on a second circle with a larger second diameter (R2) than the first radius (R1), and include: a first injection port (31*a*), a center of an opening of which is provided on the first circle; and a second injection port (31*c*), a center of an opening of which is provided at a position on the second circle on an opposite side of a tangent (F-F) of the first circle passing the center of the opening of the first injection port (31*a*) from a center axis (CF1) of the fuel injector (30), that the first circle and the second circle are concentric circles, and a center of the first circle and a center of the second circle are located on the center axis of the fuel injector (30), and that a first angle (θ1) defined by a center axis (CF2) of the first injection port (31*a*) and the center axis (CF1) of the fuel injector (30) is larger than a second angle (θ2) defined by a center axis (CF3) of the second injection port (31*c*) and the center axis (CF1) of the fuel injector (30).

According to such a configuration, it is configured that, of the plural injection ports (31*a* to 31*f*), when the first injection port (31*a*), the center of the opening of which is provided on the first circle, and the second injection port (31*c*), the center of the opening of which is provided at the position on the second circle on the opposite side of the tangent (F-F) of the first circle, which passes the center of the opening of the first injection port (31*a*), from the center axis (CF1) of the fuel injector (30) are seen in a cross section on the shortest line connecting the center of the first injection port (31*a*) and the center of the second injection port (31*c*), the first angle (θ1) defined by the center axis (CF2) of the first injection port (31*a*) and the center axis (CF1) of the fuel injector (30) is larger than the second angle (θ2) defined by the center axis (CF3) of the second injection port (31*c*) and the center axis (CF1) of the fuel injector (30). In this way, it can be configured that, of edges on an injection upstream side of the first injection port (31*a*), at least an edge (32*a*) on a side not opposing an edge on an injection upstream side of the second injection port (31*c*) has an obtuse angle, and, in regard to the first injection port (31*a*), a flux of the fuel flowing into the first injection port (31*a*) from the edge (32*a*) on the side not opposing the second injection port (31*c*) can be less likely to be separated from an inner wall surface of the first injection port. In addition, since it is configured that the second injection port (31*c*) is provided on the second circle on the opposite side of the tangent (F-F) of the first circle from the center axis (CF1) of the fuel injector (30), it is possible to reduce a flow rate of the fuel that flows into the first injection port from the edge (32*a*) on the injection upstream side of the first injection port (31*a*) by causing the fuel present between the first injection port (31*a*) and the second injection port (31*c*) to flow into each of the injection ports (31*a*, 31*c*), and, in regard to the first injection port (31*a*), a flux of the fuel flowing into the first injection port (31*a*) from an edge (32*b*) on a side opposing the second injection port (31*c*) can be less likely to be separated from the inner wall surface of the first injection port. In this way, in regard to the first injection port (31*a*), it is possible to favorably balance the fuel flow from the side not opposing the second injection port (31*c*) and the fuel flow from the side opposing the second injection port (31*c*) by exerting a fuel flow by the second injection port (31*c*) to the fuel flow by the first injection port (31*a*), so as to suppress the separation of the fuel flow in the injection port of the first injection port (31*a*).

Here, in the fuel injector according to the present invention, the first angle (θ1) is each angle on an acute angle side of angles defined by the center axis (CF2) of the first injection port (31*a*) and the center axis (CF1) of the fuel injector (30). The second angle (2) is each angle on an acute angle side of angles defined by the center axis (CF3) of the second injection port (31*c*) and the center axis (CF1) of the fuel injector (30).

The fuel injector according to the present invention is the fuel injector (30) that injects fuel into the internal combustion engine (10) from the plural injection ports (31*a* to 31*f*). In the fuel injector (30), it is configured that the plural injection ports (31*a* to 31*f*) are provided in plural on the first circle with the first radius (R1) and on the second circle with the larger second diameter (R2) than the first radius (R1), and include: the first injection port (31*a*), a center of an opening of which is provided on the first circle; and the second injection port (31*c*), a center of an opening of which is provided on the second circle on an opposite side of a tangent of the first circle passing the center of the opening of the first injection port (31*a*) from a center axis of the fuel injection (30), that, when seen in a cross section on the shortest line connecting the center of the first injection port (31*a*) and the center of the second injection port (31*c*), of edges on an injection upstream side of the first injection port (31*a*), at least the edge (32*a*) on a side not opposing the edge (32*d*) on an injection upstream side of the second injection port (31*c*) has an obtuse angle.

With such a configuration, it is configured that, of the plural injection ports (31*a* to 31*f*), when the first injection port (31*a*), the center of the opening of which is provided on the first circle, and the second injection port (31*c*), the center of the opening of which is provided on the second circle on the opposite side of the tangent (F-F) of the first circle, which passes the center of the opening of the first injection port (31*a*), from the center axis (CF1) of the fuel injection (30) are seen in the cross section on the shortest line connecting the center of the first injection port (31*a*) and the center of the second injection port (31*c*), of the edges on the injection upstream side of the first injection port (31*a*), at least the edge (32*a*) on the side not opposing the edge on the injection upstream side of the second injection port (31*c*) has the obtuse angle. Thus, in regard to the first injection port (31*a*), the flux of the fuel flowing into the first injection port (31*a*) from the edge (32*a*) on the side not opposing each other can be less likely to be separated from the inner wall surface of the first injection port. In addition, since it is configured that the second injection port (31*c*) is provided on the second circle on the opposite side of the tangent (F-F) of the first circle from the center axis (CF1) of the fuel injector (30), it is possible to reduce a flow rate of the fuel that flows into the first injection port from the edge (32*b*) on the injection upstream side of the first injection port by causing the fuel present between the first injection port (31*a*) and the second injection port (31*c*) to flow into each of the injection ports (31*a*, 31*c*), and, in regard to the first injection port (31*a*), a flux of the fuel flowing into the first injection port (31*a*) from the edge (32*b*) on a side opposing the second injection port (31*c*) can be less likely to be separated from the inner wall surface of the first injection port. In this way, it is possible to favorably balance the fuel flow into the first injection port (31*a*) from the side not opposing the second injection port (32*c*) and the fuel flow thereinto from the side opposing the second injection port (32*c*) by exerting the fuel flow by the second injection port (31*c*) to the fuel flow by the first injection port (31*a*), so as to suppress the separation of the fuel flow in the injection port of the first injection port (31*a*).

The internal combustion engine (10) according to the present invention is configured to include the above-described fuel injector (30). According to such a configuration, since the internal combustion engine (10) includes the above-described fuel injector (30), it is possible to suppress the separation of the fuel flow in the first injection port (31*a*) at least during fuel injection, and it is possible to reduce adhesion of the fuel to a tip of the fuel injector (30) and the like, which is a cause of a deposit produced by incomplete combustion.

The present invention may only have the matters used to define the invention and described in the claims of the present invention, or may have a configuration other than the matters used to define the invention in addition to the matters used to define the invention and described in the claims of the present invention.

BRIEF DESCRIPTION OF THE DRAWINGS

FIG. 1 is a view for explaining an internal combustion engine that includes a fuel injector according to an embodiment.

FIG. 2 is a side view of the fuel injector.

FIG. 3 is a view for explaining fuel injection ports provided to the fuel injector.

FIG. 4 is an enlarged view of inside of a frame C in FIG. 3.

FIG. 5 is a cross-sectional view that is taken along line B-B in FIG. 3.

DETAILED DESCRIPTION

A description will hereinafter be made on an exemplary embodiment of a fuel injector and an internal combustion engine including the fuel injector according to the present invention with reference to the drawings. A configuration, operation, and the like of the embodiment, which will be described below, constitute merely one example, and the present invention is not limited to a case with such a configuration, such operation, and the like. The same or similar description will appropriately be simplified or will not be made below. In the drawings, the same or similar members or portions will not be denoted by a reference sign or will be denoted by the same reference sign. A detailed structure will appropriately be illustrated in a simplified manner or will not be illustrated.

The fuel injector according to this embodiment can be applied as a fuel injector that injects fuel in an internal combustion engine (for example, a gasoline engine, a diesel engine, or the like). The internal combustion engine including the fuel injector according to the present invention, for example, an internal combustion engine that uses gasoline as the fuel can be applied as an internal combustion engine for a vehicle, a power generator, or the like. In this embodiment, a description will be made on an example in which the gasoline internal combustion engine for a vehicle is used as the internal combustion engine. However, the present invention is not particularly limited thereto.

Embodiment

[Regarding Internal Combustion Engine]

A description will be made on a configuration of an internal combustion engine 10 according to this embodiment with reference to FIG. 1. As illustrated in FIG. 1, the internal combustion engine 10 includes: an engine body 20 that forms a combustion chamber 21; a fuel injector 30 that injects fuel into the combustion chamber 21; an ignition plug 40 that generates spark discharge in the combustion chamber 21; an intake valve 50 that connects/disconnects the combustion chamber 21 to/from an intake passage 24; an exhaust valve 60 that connects/disconnects the combustion chamber 21 to/from an exhaust passage 25; a piston 70 that operates linearly in conjunction with combustion of air-fuel mixture, which contains the fuel and air, in the combustion chamber 21; a connecting rod 80 and a crankshaft (not illustrated) that convert the linear operation of the piston 70 into rotational motion; a fuel supplier (not illustrated) that supplies the fuel from a fuel tank (not illustrated), which stores the fuel, to the fuel injector 30; and the like.

The engine body 20 includes a cylinder head 22 and a cylinder block 23, and the cylinder head 22 and the cylinder block 23 form the combustion chamber 21. In the cylinder head 22, a first attachment hole 26 is formed near a joint section between the cylinder head 22 and the intake passage 24, and communicates with the combustion chamber 21 from outside of the cylinder head 22. The fuel injector 30 is inserted in the first attachment hole 26. In addition, in the cylinder head 22, a second attachment hole 27 is formed between an attachment position of the intake valve 50 and an attachment position of the exhaust valve 60, and communicates with the combustion chamber 21 from the outside of the cylinder head 22. The ignition plug 40 is inserted in the second attachment hole 27.

The fuel injector 30 is inserted in the first attachment hole 26 such that a valve seat plate 36, which is provided with plural injection ports 31*a* to 31*f* injecting the fuel, faces the combustion chamber 21, and directly injects the fuel into the combustion chamber 21. A seal section 38 is provided to an outer circumference of a tip portion of the fuel injector 30, and is configured to close a clearance between the fuel injector 30 and the first attachment hole 26 so as to seal burned gas from the combustion chamber 21.

The tip of the fuel injector 30 is configured to face the inside of the combustion chamber 21 when the fuel injector 30 is inserted in the first attachment hole 26. In this way, the fuel injector 30 can directly inject a fuel spray into the combustion chamber 21.

In this embodiment, in the cylinder head 22, the first attachment hole 26 is configured to be provided near the joint section between the cylinder head 22 and the intake passage 24. However, in the cylinder head 22, the first attachment hole 26 may be configured to be provided between the attachment position of the intake valve 50 and the attachment position of the exhaust valve 60. Even in such a configuration, the tip of the fuel injector 30 is configured to face the inside of the combustion chamber 21 when the fuel injector 30 is inserted in the first attachment hole 26, and the fuel injector 30 can directly inject the fuel spray into the combustion chamber 21.

In addition, the fuel injector 30 is configured to be arranged such that the tip thereof faces the combustion chamber 21. However, the fuel injector 30 may be configured to be arranged such that the tip thereof faces the intake passage 24.

[Regarding Fuel Injector]

A description will be made on the fuel injector 30 according to this embodiment with reference to FIG. 1 to FIG. 5. As illustrated in FIG. 1, the fuel injector 30 is attached near the joint section between the cylinder head 22 and the intake passage 24 such that a center axis CF1 of the fuel injector 30 is oriented slightly downward (oriented to the piston 70 side) in the combustion chamber 21 and that the injection ports 31*a* to 31*f*, each of which is provided to the tip portion of the fuel injector 30, faces the inside of the combustion chamber 21.

As illustrated in FIG. 2, the fuel injector 30 includes: the valve seat plate 36 that is formed with the plural injection ports 31*a* to 31*f* and is also formed with a valve seat section 36*a*; a valve body 35 that can block a fuel supply to the injection ports 31*a* to 31*f* when abutting the valve seat section 36*a*; a solenoid coil 33 that can cause the valve body 35 to move between a position where the valve body 35 abuts the valve seat section 36*a* and a position where the valve body 35 does not abut the valve seat section 36*a*; a spring 34 that urges the valve body 35; and the like.

An inner side of the valve seat plate 36 is formed in a dome shape that corresponds to a ball shape of a tip section 35*a* of the valve body 35. On the inner side of the valve seat plate 36, the valve seat section 36*a* is formed in a portion that the tip section 35*a* of the valve body 35 abuts, and forms a seal when the tip section 35*a* and the valve seat section 36*a* contact each other. In addition, on an inner side of the valve seat section 36*a* (the center axis CF1 side of the fuel injector 30) in the valve seat plate 36, the plural injection ports 31*a* to 31*f*, each of which communicates between the inside and the outside of the valve seat plate 36, are formed.

The fuel injector 30 is an electromagnetic valve of a Normal Close (NC) type that is brought into a closed state where the fuel is not injected from the injection ports 31*a* to 31*f* in a non-energized state where a specified voltage is not applied to the solenoid coil 33. When the solenoid coil 33 is in the non-energized state, the ball-shaped tip section 35*a* of the valve body 35, which is urged by the spring 34, tightly contacts the valve seat section 36*a* of the valve seat plate 36. As a result, the fuel injector 30 is brought into the closed state where the fuel supplied from a fuel supply port 37 does not leak from the injection ports 31*a* to 31*f*. On the contrary, in an energized state where the specified voltage is applied to the solenoid coil 33, the valve body 35 moves to a position away from the valve seat section 36*a* of the valve seat plate 36, and a clearance is produced between the valve body 35 and the valve seat section 36*a*. In this way, the fuel injector 30 is brought into an open state where the fuel supplied from the fuel supply port 37 flows through the clearance between the valve body 42 and the valve seat section 36*a* and is injected in the spray form from the injection ports 31*a* to 31*f*.

In this embodiment, the fuel injector 30 is configured to be switched between the open state and the closed state by the solenoid coil. However, the fuel injector 30 may be configured to be switched between the open state and the closed state by a piezoelectric element or the like, for example.

The fuel that is supplied from the fuel supply port 37 into the fuel injector 30 flows through a channel (not illustrated) provided in the fuel injector 30, and reaches the valve seat section 36*a* of the valve seat plate 36. In the open state of the fuel injector 30, after reaching the valve seat section 36*a*, the fuel flows through a constricted portion between the tip section 35*a* of the valve body 35 and the valve seat section 36*a*, then flows in a direction of the center axis CF1 of the fuel injector 30, and reaches the injection ports 31*a* to 31*f*. Then, the fuel flows through the injection ports 31*a* to 31*f* and is injected into the combustion chamber 21 (see FIG. 5). On the contrary, in the closed state of the fuel injector 30, the constricted portion between the tip section 35*a* of the valve body 35 and the valve seat section 36*a* is closed, and thus the fuel injection into the combustion chamber 21 is blocked.

[Regarding Injection Ports]

A description will be made on the injection ports 31*a* to 31*f* of the fuel injector 30 according to this embodiment with reference to FIG. 3 to FIG. 5. FIG. 3 is a view illustrating the valve seat plate 36 that is seen from the center axis CF1 of the fuel injector 30 (an arrow A direction in FIG. 2). FIG. 4 is an enlarged view of inside of a frame C in FIG. 3. FIG. 5 is a cross-sectional view of the tip portion of the fuel injector 30 that is taken along line B-B as the shortest line connecting a center of the first injection port 31*a* and a center of the second injection port 31*c*, which will be described below, in FIG. 4.

As illustrated in FIG. 3 and FIG. 4, in the valve seat plate 36 of the fuel injector 30, the plural injection ports 31*a* to 31*f*, each of which communicates between the inside and the outside of the valve seat plate 36, are perforated, and the injection ports 31*a* to 31*f* include the first injection port 31*a* and the second injection port 31*c*, which will be described below. The first injection port 31*a* is perforated such that a center of an opening of the injection port is located on a first circle with a first radius R1 from the center axis CF1 of the fuel injector 30. The second injection port 31*c* is perforated such that a center of an opening of the injection port 31*c* is located on a second circle with a larger second radius R2 than the first radius R1 from the center axis CF1 of the fuel injector 30 and is located on an opposite side of a tangent F-F of the first circle, which passes the center of the opening of the first injection port 31*a*, from the center axis CF1 of the fuel injector 30 (on a shorter arc $\alpha$ of arcs of the second circle passing points where the tangent F-F intersects the second circle). In addition, the injection port 31*c* is perforated such that the center of the opening of the injection port 31*c* is located at a position on the second circle, the position being located at approximately 30° from a perpendicular line D-D to the tangent F-F, which passes the injection port 31*a*.

The injection port 31*b* is perforated such that a center of an opening thereof is located at a specified position on the first circle, and the injection ports 31*d* to 31*f* are perforated such that a center of an opening of each thereof is located at a specified position on the second circle. Here, a positional relationship between the injection port 31*b* and the injection port 31*d* is similar to a positional relationship between the injection port 31*a* and the injection port 31*c*. The injection port 31*d* is perforated such that a center of an opening of the injection port 31*d* is located on the second circle with the second radius R2 from the center axis CF1 of the fuel injector 30 and is located on an opposite side of a tangent of the first circle, which passes the center of the opening of the injection port 31*b*, from the center axis CF1 of the fuel injector 30.

As illustrated in FIG. 5, when seen in a cross section on a plane that includes line B-B as the shortest line connecting the center of the first injection port 31*a* and the center of the second injection port 31*c* and that is parallel to the center axis CF1 of the fuel injector 30, an angle of a projection angle that is projected to the cross section, that is, a projection angle defined by a center axis CF2 of the first injection port 31*a* and the center axis CF1 of the fuel injector 30 is set as a first angle θ1. An angle of a projection angle that is projected to the cross section similarly and that is defined by a center axis CF3 of the second injection port 31*c* and the center axis CF1 of the fuel injector 30 is set as a second angle θ2. In this case, the first injection port 31*a* and the second injection port 31*c* are perforated such that the first angle θ1 becomes larger than the second angle θ2.

Here, as illustrated in FIG. 5, the first angle θ1 is each angle on an acute angle side of the projection angles defined by the center axis CF2 of the first injection port 31*a* and the center axis CF1 of the fuel injector 30. The second angle θ2 is each angle on an acute angle side of the projection angles defined by the center axis CF3 of the second injection port 31*c* and the center axis CF1 of the fuel injector 30.

The first injection port 31*a* and the second injection port 31*c* are each perforated such that, in regard to edges 32*a* to 32*d* of the openings on an injection upstream side (an inner circumferential surface side of the valve seat plate 36) of the first injection port 31*a* and the second injection port 31*c*, the edge 32*a* (the edge 32*a* on the center axis CF1 side of the fuel injector 30 in regard to the tangent of the first circle passing the center of the first injection port 31*a*) of the first injection port 31*a* and the edge 32*d* (the edge 32*d* on an opposite side from the center axis CF1 of the fuel injector 30 in regard to the tangent of the second circle passing the center of the second injection port 31*c*) of the second injection port 31*c* on sides not opposing each other have obtuse angles and that the edge 32*b* (the edge 32*b* on an opposite side of the center axis CF1 side of the fuel injector 30 in regard to the tangent of the first circle passing the center of the first injection port 31*a*) of the first injection port 31*a* and the edge 32*c* (the edge 32*c* on the center axis CF1 side of the fuel injector 30 in regard to the tangent of the second circle passing the center of the first injection port 31*a*) of the second injection port 31*c* on sides opposing each other have acute angles.

The injection ports 31*a* to 31*f* are each formed with a guide area L, which is formed on the upstream side (on the inner side of the valve seat plate 36) and has a small diameter, and a diffusion area M, which is formed on a downstream side (the combustion chamber 21 side) and is formed by counter-boring to have a larger diameter than the guide area L. A bottom surface of the diffusion area M is formed in a step shape that is orthogonal to a center axis of the guide area L, for example. The fuel that is injected from the guide area L into the combustion chamber 21 via the diffusion area M is diffused as the spray. Here, each of the center axis CF2 of the first injection port 31*a* and the center axis CF3 of the second injection port 31*c* described above corresponds to the center axis of the guide area L in the each injection port. A ratio ε (ε=1/d) of a diameter d of each of the injection ports 31*a* to 31*f* to a depth 1 of the guide area L of each injection port is approximately 1. Compared to a case where the fuel injector 30 is applied to an internal combustion engine with a relatively high fuel injection pressure (for example, the diesel engine), when the fuel injector 30 is applied to an internal combustion engine with a relatively low fuel injection pressure (for example, the gasoline engine), the tip section of the fuel injector is designed to be thin, and the ratio £ of the diameter d of the injection port to the depth 1 of the guide area L in the injection port of the fuel injector tends to be low. For example, the ratio £ is approximately 1 to 3 for the fuel injector in the gasoline engine, and the ratio £ is approximately 5 to 10 for the fuel injector in the diesel engine. The guide area in the injection port of the fuel injector in the gasoline engine is shorter than that of the fuel injector in the diesel engine, and the fuel flow tends to be separated from an inner wall surface of the injection port of the fuel injector in the gasoline engine when compared to that of the fuel injector in the diesel engine.

As described above, the fuel injector 30 according to this embodiment includes the plural injection ports 31*a* to 31*f*, each of which injects the fuel into the internal combustion engine 10, and the injection ports 31*a* to 31*f* are provided in plural on the first circle with the first radius R1 and on the second circle with the larger second radius R2 than the first radius R1.

In the fuel injector 30 according to this embodiment, the plural injection ports 31*a* to 31*f* include the first injection port 31*a* and the second injection port 31*c*. The center of the opening of the first injection port 31*a* is provided on the first circle. The center of the opening of the second injection port 31*c* is provided on the second circle on the opposite side of the tangent F-F of the first circle, which passes the center of the opening of the first injection port 31*a*, from the center axis CF1 of the fuel injector 30. In addition, the first circle provided with the first injection port 31*a* and the second circle provided with the second injection port 31*c* are concentric circles, a center of each of which is set on the center axis CF1 of the fuel injector 30.

In the fuel injector 30 according to this embodiment, it is configured that, when seen in the cross section on the line B-B as the shortest line connecting the center of the first injection port 31*a* and the center of the second injection port 31*c*, the first angle θ1, which is defined by the center axis CF2 of the first injection port 31*a* and the center axis CF1 of the fuel injector 30, is larger than the second angle θ2, which is defined by the center axis CF3 of the second injection port 31*c* and the center axis CF1 of the fuel injector 30.

In the fuel injector 30 according to this embodiment, the first injection port 31*a* and the second injection port 31*c* are configured that the edge on the injection upstream side of the first injection port 31*a* and the edge on the injection upstream side of the second injection port 31*c* on the sides not opposing each other have the obtuse angles and that the edge on the injection upstream side of the first injection port 31*a* and the edge on the injection upstream side of the second injection port 31*c* on the sides opposing each other have the acute angles. In addition, in regard to the first injection port 31*a* and the second injection port 31*c*, the edge on the injection upstream side of the first injection port 31*a* and the edge on the injection upstream side of the second injection port 31*c* on the sides opposing each other have the acute angles, and the second injection port is provided on the second circle on the opposite side of the tangent F-F of the first circle, which passes the center of the opening of the first injection port 31*a*, from the center axis CF1 of the fuel injector.

The number of the injection ports perforated in the fuel injector 30, the arrangement and size of an aperture of each of the injection ports, the angle defined by the axis of the injection port and the center axis CF1 of the fuel injector 30, the shape of the counterbore, and the like can be designed according to design of the internal combustion engine 10, to which the fuel injector 30 is attached.

In this embodiment, the injection port 31*c* is configured to be perforated such that the center of the opening of the injection port 31*c* is located at the position on the second circle and that the position is located at the angle of approximately 30° from the perpendicular line D-D to the tangent F-F, which passes the first injection port 31*a*. However, the second injection port 31*c* may be at least configured to be located on the arc of the second circle on the opposite side of the tangent F-F from the center axis CF1 of the fuel injector 30, that is, may be perforated such that the center of the opening of the injection port 31*c* is located on the second circle within a range of ±90° from the perpendicular line D-D to the tangent F-F, which passes the first injection port 31*a*. In the configuration of the injection port 31*c* perforated such that the center of the opening of the injection port 31*c* is located on the second circle within the range of ±90° from the perpendicular line D-D to the tangent F-F, which passes the first injection port 31*a*, it is possible to suppress the separation of the fuel flow from the inner wall surface of each of the injection ports by a mutual interaction between an influence of the first injection port 31*a* on the fuel flow and an influence of the second injection port 31*c* on the fuel flow. The second injection port 31*c* can have the greater influence on the fuel flow into the first injection port 31*a* as being located on the arc of the second circle that is closer to the perpendicular line D-D, and it is preferably configured that the center of the opening of the injection port 31*c* is located on the arc of the second circle within a range of ±45° from the perpendicular line D-D to the tangent F-F, which passes the first injection port 31*a*. Compared to a configuration that the center of the opening of the injection port 31*c* is located on the arc of the second circle within a range of ±45° to 90° from the perpendicular line D-D to the tangent F-F, which passes the first injection port 31*a*, in the configuration that the center of the opening of the injection port 31*c* is located on the arc of the second circle within the range of ±45° from the perpendicular line D-D to the tangent F-F, which passes the first injection port 31*a*, it is possible to exhibit the further significant mutual interaction between the influence of the first injection port 31*a* on the fuel flow and the influence of the second injection port 31*c* on the fuel flow.

[Regarding Operational Effects]

In general, near the edge on the injection upstream side of the injection port in the fuel injector, as a portion has the acuter edge angle, the fuel flow is more likely to be separated from the inner wall surface of the injection port than another portion. In addition, as a flow rate is increased, the fuel flow is more likely to be separated from the inner wall surface of the injection port. Furthermore, as the ratio ε (ε=1/d) of the diameter d of the injection port to the depth 1 of the guide area L formed in the injection port is reduced, that is, as the guide area L is shorter, the fuel flow through the injection port is less likely to be rectified from a turbulent flow state before being injected from an outlet on the downstream side, and the fuel flow tends to be separated from the inner wall surface of the injection port. In particular, in the case where the ratio ε falls below approximately 3, likeliness of the separation of the fuel flow tends to be significantly increased when compared to a case where the ratio exceeds 3. Then, when the fuel flow is separated, there is a possibility that disturbance occurs in a flow field and that the spray of the fuel injected from the injection port spatters around the injection port, produces droplets, and adheres to an outer circumferential wall surface at the tip of the fuel injector and the like. In the internal combustion engine 10 in which the tip section of the fuel injector 30 is arranged to face the inside of the combustion chamber 21, the fuel adheres to the tip of the fuel injector 30 and the like, and the adhered fuel is burned incompletely, which becomes a cause of producing unburned particle matters.

The fuel injector 30 in this embodiment is the fuel injector 30 that injects the fuel into the internal combustion engine 10 from the plural injection ports 31*a* to 31*f*, and is provided with the plural injection ports 31*a* to 31*f* on the first circle with the first radius R1 and on the second circle with the larger second radius R2 than the first radius R1. The ratio ε of the diameter d of each of the injection ports 31*a* to 31*f* to the depth 1 of the guide area L formed in each injection port is approximately 1, and the fuel flow through each of the injection ports is less likely to be rectified before being injected from the outlet on the downstream side.

To handle the above problem, in the fuel injector 30, the plural injection ports 31*a* to 31*f* include: the first injection port 31*a*, the center of the opening of which is provided on the first circle; and the second injection port 31*c*, the center of the opening of which is provided on the second circle on the opposite side of the tangent of the first circle, which passes the center of the opening of the first injection port 31*a*, from the center axis CF1 of the fuel injection 30. In addition, the first injection port 31*a* and the second injection port 31*c* are configured that, when seen in the cross section on the line B-B as the shortest line connecting the center of the first injection port 31*a* and the center of the second injection port 31*c*, the first angle θ1, which is defined by the center axis CF2 of the first injection port 31*a* and the center axis CF1 of the fuel injector 30, is larger than the second angle θ2, which is defined by the center axis CF3 of the second injection port 31*c* and the center axis CF1 of the fuel injector 30.

According to such a configuration, the first injection port 31*a* and the second injection port 31*c* can be configured that, when seen in the cross section on the shortest line connecting the center of the first injection port 31*a* and the center of the second injection port 31*c*, of the edges on the injection upstream side of the first injection port 31*a*, at least the edge 32*a* on the side not opposing the edge 32*d* on the injection upstream side of the second injection port 31*c* can have the obtuse angle, and in regard to the first injection port 31*a*, a flux of the fuel flowing into the first injection port 31*a* from the edge 32*a* on the side not opposing the second injection port 31*c* can be less likely to be separated from the inner wall surface of the first injection port. In addition, since it is configured that the second injection port 31*c* is provided on the second circle on the opposite side of the tangent F-F of the first circle from the center axis CF1 of the fuel injector 30, it is possible to cause the fuel present between the first injection port 31*a* and the second injection port 31*c* to flow into each of the injection ports 31*a*, 31*c*, so as to reduce the flow rate of the fuel that flows into the first injection port 31*a* from the edge 32*b* on the side opposing the second injection port 31*c* among the edges on the injection upstream side of the first injection port 31*a*. In this way, in regard to the first injection port 31*a*, the flux of the fuel flowing into the first injection port 31*a* from the edge 32*b* on the side opposing the second injection port 31*c* can be less likely to be separated from the inner wall surface of the first injection port. From what have been described so far, in regard to the first injection port 31*a*, it is possible to favorably balance the fuel flow from the side not opposing the second injection port 31*c* and the fuel flow from the side opposing the second injection port 31*c* by exerting the influence of the fuel flow by the second injection port 31*c* on the fuel flow by the first injection port 31*a*. As a result, it is possible to suppress the separation of the fuel flow from the inner wall surface in the injection port of the first injection port 31*a*.

According to the configuration that the first angle θ1 related to the first injection port 31*a* is larger than the second angle θ2 related to the second injection port 31*c*, the first injection port 31*a* and the second injection port 31*c* can be configured that the edge 32*a* on the injection upstream side of the first injection port 31*a* and the edge 32*d* on the injection upstream side of the second injection port 31*c* on the sides not opposing each other can have the obtuse angles, and in regard to the first injection port 31*a* and the second injection port 31*c*, the flux of the fuel flowing into each of the injection ports 31*a*, 31*c* from respective one of the edges 32*a*, 32*d* on the sides not opposing each other can be less likely to be separated from the inner wall surface of each injection port. In addition, since the second injection port is provided on the second circle on the opposite side of the tangent F-F of the first circle, which passes the center of the opening of the first injection port 31*a*, from the center axis CF1 of the fuel injector, it is possible to cause the fuel present between the first injection port 31*a* and the second injection port 31*c* to flow into each of the injection ports 31*a*, 31*c*, so as to reduce the flow rate of the fuel that flows into each of the injection ports from respective one of the edges 32*b*, 32*c* on the injection upstream side of the injection ports. In this way, in regard to the first injection port 31*a* and the second injection port 31*c*, the flux of the fuel flowing into each of the injection ports 31*a*, 31*c* from respective one of the edges 32*b*, 32*c* on the sides opposing each other can be less likely to be separated from the inner wall surface of each injection port. From what have been described so far, in regard to the first injection port 31*a* and the second injection port 31*c*, it is possible to favorably balance the fuel flows from the sides not opposing each other and the fuel flows from the sides opposing each other by the mutual interaction between the influence of the first injection port 31*a* on the fuel flow and the influence of the second injection port 31*c* on the fuel flow. As a result, it is possible to suppress the separation of the fuel flow in the injection port of each of the first injection port 31*a* and the second injection port 31*c*.

The fuel injector 30 in this embodiment is the fuel injector 30 that injects the fuel into the internal combustion engine 10 from the plural injection ports 31*a* to 31*f*, and is configured that the plural injection ports 31*a* to 31*f* are provided in plural on the first circle with the first radius R1 and on the second circle with the larger second radius R2 than the first radius R1 and include: the first injection port 31*a*, the center of the opening of which is provided on the first circle; and the second injection port 31*c*, the center of the opening of which is provided on the second circle on the opposite side of the tangent of the first circle, which passes the center of the opening of the first injection port 31*a*, from the center axis CF1 of the fuel injection 30, and that, when seen in the cross section on the shortest line connecting the center of the first injection port 31*a* and the center of the second injection port 31*c*, of the edges on the upstream side of the first injection port 31*a*, at least the edge 32*a* on the side not opposing the second injection port 31*c* has the obtuse angle.

According to such a configuration, due to the configuration that, when the first injection port 31*a* is seen in the cross section on the shortest line connecting the center of the first injection port 31*a* and the center of the second injection port 31*c*, of the edges on the injection upstream side of the first injection port 31*a*, the edge 32*a* on the side not opposing the second injection port 31*c* has the obtuse angle, in regard to the first injection port 31*a*, the flux of the fuel flowing into the first injection port 31*a* from the edge 32*a* on the side not opposing the second injection port 31*c* can be less likely to be separated from the inner wall surface of the first injection port. In addition, due to the configuration that the second injection port 31*c* is provided on the second circle on the opposite side of the tangent line F-F of the first circle from the center axis CF1 of the fuel injector 30, it is possible to cause the fuel present between the first injection port 31*a* and the second injection port 31*c* to flow into each of the injection ports 31*a*, 31*c*, so as to reduce the flow rate of the fuel flowing into the first injection port 31*a* from the edge 32*b* on the side opposing the second injection port 31*c* among the edges on the injection upstream side of the first injection port 31*a*. In this way, in regard to the first injection port 31*a*, the flux of the fuel flowing into the first injection port 31*a* from the edge 32*b* on the side opposing the second injection port 31*c* can be less likely to be separated from the inner wall surface of the first injection port 31*a*. From what have been described so far, in regard to the first injection port 31*a*, it is possible to favorably balance the fuel flow from the side not opposing the second injection port 31*c* and the fuel flow flowing from the side opposing the second injection port 31*c* by exerting the influence of the fuel flow by the second injection port 31*c* on the fuel flow by the first injection port 31*a*. As a result, it is possible to suppress the separation of the fuel flow from the inner wall surface in the injection port of the first injection port 31*a*.

The fuel injector 30 in this embodiment is the fuel injector 30 that injects the fuel into the internal combustion engine 10 from the plural injection ports 31*a* to 31*f*, and is configured that the plural injection ports 31*a* to 31*f* are provided in plural on the first circle with the first radius R1 and on the second circle with the larger second radius R2 than the first radius R1 and include: the first injection port 31*a*, the center of the opening of which is provided on the first circle; and the second injection port 31*c*, the center of the opening of which is provided on the second circle on the opposite side of the tangent of the first circle, which passes the center of the opening of the first injection port 31*a*, from the center axis CF1 of the fuel injection 30, and that, when seen in the cross section on the shortest line connecting the center of the first injection port 31*a* and the center of the second injection port 31*c*, the edge 32*a* on the injection upstream side of the first injection port 31*a* and the edge 32*d* on the injection upstream side of the second injection port 31*c* on the sides not opposing each other have the obtuse angles.

According to such a configuration, it is configured that, of the plural injection ports 31*a* to 31*f*, when the first injection port 31*a*, the center of the opening of which is provided on the first circle, and the second injection port 31*c*, the center of the opening of which is provided on the second circle on the opposite side of the tangent F-F of the first circle passing the center of the opening of the first injection port 31*a* from the center axis CF1 of the fuel injection 30, are seen in the cross section on the shortest line connecting the center of the first injection port 31*a* and the center of the second injection port 31*c*, the edge 32*a* on the injection upstream side of the first injection port 31*a* and the edge 32*d* on the injection upstream side of the second injection port 31*c* on the sides not opposing each other have the obtuse angles. Accordingly, in regard to the first injection port 31*a* and the second injection port 31*c*, the flux of the fuel flowing into each of the injection ports 31*a*, 31*c* from respective one of the edges 32*a*, 32*d* on the sides not opposing each other can be less likely to be separated from the inner wall surface of each injection port. In addition, since it is configured that the second injection port 31*c* is provided on the second circle on the opposite side of the tangent F-F of the first circle from the center axis CF1 of the fuel injector 30, it is possible to cause the fuel present between the first injection port 31*a* and the second injection port 31*c* to flow into each of the fuel injection ports 31*a*, 31*c*, so as to reduce the flow rate of the fuel flowing into each of the injection ports from respective one of the edges 32*a*, 32*d* on the injection upstream sides of the injection ports. In this way, in regard to the first injection port 31*a* and the second injection port 31*c*, the flux of the fuel flowing into each of the injection ports 31*a*, 31*c* from respective one of the edges 32*b*, 32*c* on the sides opposing each other can be less likely to be separated from the inner wall surface of each injection port. From what have been described so far, in regard to the first injection port 31*a* and the second injection port 31*c*, it is possible to favorably balance the fuel flows from the sides not opposing each other and the fuel flows from the sides opposing each other by the mutual interaction between the influence of the first injection port 31*a* on the fuel flow and the influence of the second injection port 31*c* on the fuel flow. As a result, it is possible to suppress the separation of the fuel flow in the injection port of each of the first injection port 31*a* and the second injection port 31*c*.

The fuel injector 30 according to this embodiment is configured that the ratio £ of the diameter d of each of the first injection port 31*a* and the second injection port 31*c* to the length l of each injection port is equal to or lower than 3. In such a configuration, the fuel flow through the injection port is less likely to be rectified from the turbulent flow state before being injected from the outlet on the downstream side, and the fuel flow tends to be separated from the inner wall surface of the injection port. However, it is configured that the second injection port 31*c* is provided on the second circle on the opposite side of the tangent F-F of the first circle, which passes the center of the opening of the first injection port 31*a*, from the center axis CF1 of the fuel injector, and it is configured that the first angle θ1, which is defined by the center axis CF2 of the first injection port 31*a* and the center axis CF1 of the fuel injector 30, is larger than the second angle θ2, which is defined by the center axis CF3 of the second injection port 31*c* and the center axis CF1 of the fuel injector 30. Thus, it is possible to suppress the separation of the fuel flow in the injection port of each of the first injection port 31*a* and the second injection port 31*c*.

The fuel injector 30 according to this embodiment is configured that the ratio £ of the diameter d of each of the first injection port 31*a* and the second injection port 31*c* to the length l of each injection port is equal to or lower than 3. In such a configuration, the fuel flow through the injection port is less likely to be rectified from the turbulent flow state before being injected from the outlet on the downstream side, and the fuel flow tends to be separated from the inner wall surface of the injection port. However, it is configured that the second injection port 31*c* is provided on the second circle on the opposite side of the tangent F-F of the first circle, which passes the center of the opening of the first injection port 31*a*, from the center axis CF1 of the fuel injector, and it is configured that the edge 32*a* on the injection upstream side of the first injection port 31*a* and the edge 32*d* on the injection upstream side of the second injection port 31*c* on the sides not opposing each other have the obtuse angles. Thus, it is possible to suppress the separation of the fuel flow in the injection port of each of the first injection port 31*a* and the second injection port 31*c*.

In the case where the guide area L, which is formed on the upstream side and has the small diameter, and the diffusion area M, which is formed on the downstream side and is formed to have the larger diameter than the guide area L by counter-boring, are formed in the injection port, the length l of the injection port is only the length of the guide area L and does not include the length of the diffusion area M.

The internal combustion engine 10 according to this embodiment is configured to include the above-described fuel injector 30. According to such a configuration, since the internal combustion engine 10 includes the above-described fuel injector 30, it is possible to suppress the separation of the fuel flow in each of the first injection port 31*a* and the second injection port 31*c* during the fuel injection, and it is possible to reduce the adhesion of the fuel to the tip of the fuel injector 30 and the like, which is a cause of a deposit produced by the incomplete combustion.

In this embodiment, the first injection port 31*a* and the second injection port 31*c* are configured that the ratio c of the diameter d of each of the injection ports 31*a*, 31*c* to the depth 1 of the guide area L formed in each injection port is approximately 1. However, the ratio c of the diameter d of each of the injection ports to the depth 1 of the guide area L in each injection port is not limited to 1. Similar effects to those in this embodiment can be exerted with a configuration in which the ratio ε is lower than 1 and a configuration in which the ratio ε exceeds 1.

The description has been made so far on the exemplary embodiment of the present invention. However, the present invention is not limited to this exemplary embodiment, and it is needless to say that modifications and changes made to the present invention within the scope that does not depart from the gist of the present invention are included in the present invention.

REFERENCE SIGNS LIST

10: Internal combustion engine
21: Combustion chamber
22: Cylinder head
30: Fuel injector
31*a* to 31*f* Injection port

The invention claimed is:

1. A fuel injector (30) that injects fuel into an internal combustion engine (10) from plural injection ports (31*a* to 31*f*), wherein the plural injection ports (31*a* to 31*f*)

are provided in plural on a first circle with a first radius (R1) and on a second circle with a second radius (R2) that is larger than the first radius (R1), and include: a first injection port (31*a*), a center of an opening of which is provided on the first circle; and a second injection port (31*c*), a center of an opening of which is provided on the second circle on an opposite side of a tangent (F-F) of the first circle, which passes the center of the opening of the first injection port (31*a*), from a center axis (CF1) of the fuel injector (30), the first circle and the second circle are concentric circles, and a center of the first circle and a center of the second circle are located on the center axis of the fuel injector (30), and a first angle (θ1) that is defined by a center axis (CF2) of the first injection port (31*a*) and the center axis (CF1) of the fuel injector (30) is larger than a second angle (θ2) that is defined by a center axis (CF3) of the second injection port (31*c*) and the center axis (CF1) of the fuel injector (30), wherein, when seen in a cross section on the shortest line that connects the center of the first injection port (31*a*) and the center of the second injection port (31*c*), an edge (32*a*) on the injection upstream side of the first injection port (31*a*) and an edge (32*d*) on the injection upstream side of the second injection port (31*c*) on the sides not opposing each other each have an obtuse angle, and wherein the fuel injector is configured to inject fuel from the first injection port (31*a*) simultaneously with the second injection port (31*c*).

2. A fuel injector (30) that injects fuel into an internal combustion engine (10) from plural injection ports (31*a* to 31*f*), wherein the plural injection ports (31*a* to 31*f*)

are provided in plural on a first circle with a first radius (R1) and on a second circle with a second radius (R2) that is larger than the first radius (R1), and include: a first injection port (31*a*), a center of an opening of which is provided on the first circle; and a second injection port (31*c*), a center of an opening of which is provided on the second circle on an opposite side of a tangent of the first circle, which passes the center of the opening of the first injection port (31*a*), from a center axis (CF1) of the fuel injector (30)

wherein, when seen in a cross section on the shortest line that connects the center of the first injection port (31*a*) and the center of the second injection port (31*c*), an edge (32*a*) on the injection upstream side of the first injection port (31*a*) and an edge (32*d*) on the injection upstream side of the second injection port (31*c*) on the sides not opposing each other each have an obtuse angle, and wherein the fuel injector is configured to inject fuel from the first injection port (31*a*) simultaneously with the second injection port (31*c*).

3. The fuel injector according to claim 2, wherein the first circle and the second circle are concentric circles.

4. The fuel injector according to claim 2, wherein a center of the first circle and a center of the second circle are located on the center axis (CF1) of the fuel injector (30).

5. The fuel injector (30) according to claim 1, wherein a ratio (a) of a diameter (d) of each of the first injection port (31*a*) and the second injection port (31*c*) to a length (1) of respective one of the injection ports (31*a*, 31*c*) is equal to or lower than 3.

6. An internal combustion engine comprising:

the fuel injector (30) according to claim 1.

7. The fuel injector according to claim 3, wherein a center of the first circle and a center of the second circle are located on the center axis (CF1) of the fuel injector (30).

8. The fuel injector (30) according to claim 7, wherein a ratio (a) of a diameter (d) of each of the first injection port (31*a*) and the second injection port (31*c*) to a length (1) of respective one of the injection ports (31*a*, 31*c*) is equal to or lower than 3.

9. An internal combustion engine comprising:

the fuel injector (30) according to claim 8.

10. An internal combustion engine comprising:

the fuel injector (30) according to claim 2.

* * * * *